United States Patent [19]

Fox et al.

[11] Patent Number: 4,759,285

[45] Date of Patent: Jul. 26, 1988

[54] ROTOGRAVURE CYLINDER PROOFING METHOD

[75] Inventors: Russel N. Fox; Keith K. Klett, both of Danville, Ill.

[73] Assignee: Hurletron, Inc., Danville, Ill.

[21] Appl. No.: 72,910

[22] Filed: Jul. 14, 1987

[51] Int. Cl.[4] ..... B41F 9/00; B41F 29/04

[52] U.S. Cl. ..... 101/170; 101/153

[58] Field of Search ..... 101/170, 152, 153, 426, 101/216, 212, 219, DIG. 13, 150

[56] References Cited

U.S. PATENT DOCUMENTS 2,520,504 8/1950 Hooper ..... 101/426

2,558,900 7/1951 Hooper ..... 101/219

FOREIGN PATENT DOCUMENTS 1159923 7/1969 United Kingdom .

*Primary Examiner*—J. Reed Fisher

[57] ABSTRACT

A method for conducting a proofing operation of a rotogravure printing cylinder includes preparation of a steel drum having in sequence from the outer steel surface a layer of plastic such as Mylar ®, a blanket consisting of a rubber composite material, a paper/foil layer with the foil side facing outwardly, and a proofing sheet consisting of normal printing paper. The rotogravure cylinder which is to be proofed is brought into contact with the thus-prepared drum, and a high voltage is applied to the foil via the proofing sheet. The rotogravure cylinder is inked and rotated through one printing revolution so that a complete impression is made on the proofing sheet. The high voltage assists in the transfer of ink from the cups of the rotogravure cylinder to the proofing sheet. The impression produced by the rotogravure cylinder can then be checked before the rotogravure cylinder is sent to a user.

1 Claim, 2 Drawing Sheets

ROTOGRAVURE CYLINDER PROOFING METHOD

BACKGROUND OF THE INVENTION

1. Field of the Invention

The present invention is directed to a method for proofing a rotogravure cylinder, and in particular to such a method which can be undertaken at the plant of the manufacturer of the rotogravure cylinder without the necessity of installing the cylinder in the press in which it is to be actually used.

2. Description of the Prior Art

The use of high strength electrically fields to assist in the transfer of ink from a rotogravure cylinder to a moving web of paper is known in the art. Various theories exist as to why the application of such fields is effective for this purpose, however, it is believed that the ink molecules carry a charge or have a plurality and are therefore caused to move in one direction by a properly oriented electric field.

In a conventional rotogravure press section, which may have a number of rotogravure printing cylinders over which a continuous web of paper is moved, access to both sides of the web is readily available. Electrodes of opposite plurality can thus be easily placed on opposite sides of the web, so that the necessary electric field can be generated through which the web is moved. A problem in the art exists in generating a similar field in an apparatus prior to installation of the rotogravure cylinder in the actual press section in which it is to be used. For example, manufacturers of rotogravure cylinders conduct a so-called proofing operation before sending the rotogravure cylinder out of the manufacturing facility to the ultimate user. Such manufacturers do not have, and could not economically afford, a complete rotogravure press section in which to test or proof the rotogravure cylinders before sending the cylinders to a customer. It is therefore a problem in the art to provide a means for generating an electric field in a rotogravure cylinder which is completely wrapped with a proofing sheet so that a proofing operation, aided by a high strength electric field for ink transfer, can be conducted prior to shipment of the cylinder.

SUMMARY OF THE INVENTION

It is an object of the present invention to provide a method for proofing a rotogravure cylinder which can be conducted in the facility of a rotogravure cylinder manufacturer, without the necessity of the rotogravure cylinder being placed in the actual printing section in which it is to be used.

The above object is achieved in accordance with the principles of the present invention in a method wherein a steel drum is wrapped in sequence with a plastic layer, such as Mylar ® followed by a blanket layer consisting of a rubber composite material, a paper/foil layer, with the paper side of this layer being placed adjacent the blanket layer, and an outer proofing sheet which completely surrounds the exterior of the completed drum. A rotogravure cylinder to be proofed is then brought into contact with the proofing sheet on the outer surface of the drum and is inked and rotated through one printing revolution. During such rotation, a high voltage in the range of approximately 3500 volts to approximately 4700 volts is applied through the proofing sheet by a lead attached to the foil side of the paper/foil layer. The electric field induced by the application of the high voltage assist in the transfer of ink from the cups of the rotogravure cylinder to the proofing sheet, thereby simulating as closely as possible the conditions which will be present in the actual printing press in which the rotogravure cylinder is to be used.

The resulting impression on the proofing sheet can then be examined, and if necessary the rotogravure cylinder can be reengraved as needed.

DESCRIPTION OF THE PREFERRED EMBODIMENTS

Figure 1A:
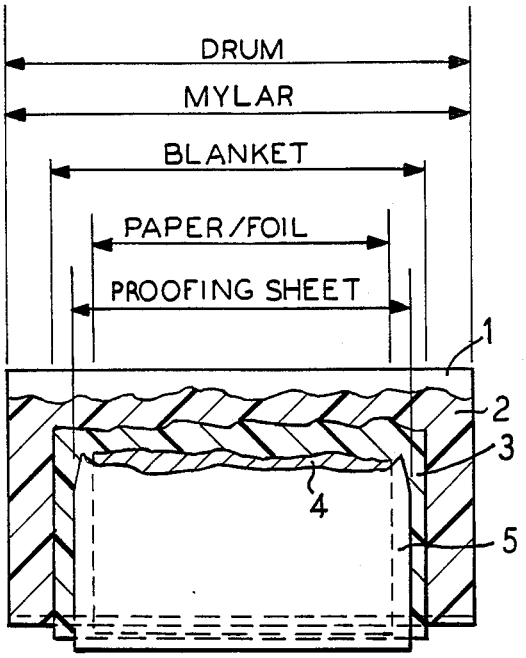
FIG. 1A is a front sectional view showing the layers of the drum used in the method according to the principles of the present invention.
Figure 1B:
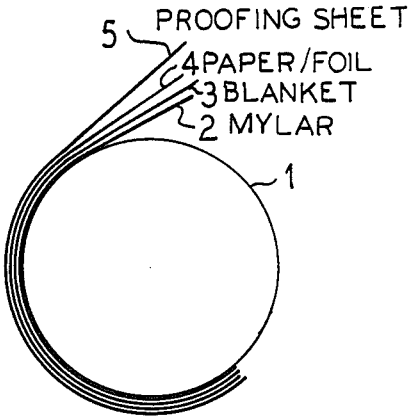
FIG. 1B is a side view showing the layers of the drum in FIG. 1 used in the method according to the principles of the present invention.

A layered drum is prepared as shown in FIG. 1 for conducting a proofing method in accordance with the principles of the present invention. The drum 1 is constructed of electrically conducting material, such as steel. The outer surface of the drum 1 is wrapped with-a layer of plastic 2, such a Mylar ®. This serves as an insulating layer for the drum 1. The plastic layer 2 is covered by a blanket layer 3, consisting of a rubber composite material. The rubber composite material is largely insulating, but has some electrically conducting capability. The blanket layer 3 is then covered by a paper/foil layer 4, which is an electrically conductive foil laminated or otherwise attached to paper, with the foil completely covering one side and the paper completely covering the other side of the layer 4. The layer 4 is arranged with the paper side toward the blanket layer 3. The proofing sheet 5 is then wrapped around the foil side of the paper/foil layer 4. The proofing sheet is to be printed with an impression from a rotogravure cylinder during a proofing operation.

Figure 2:
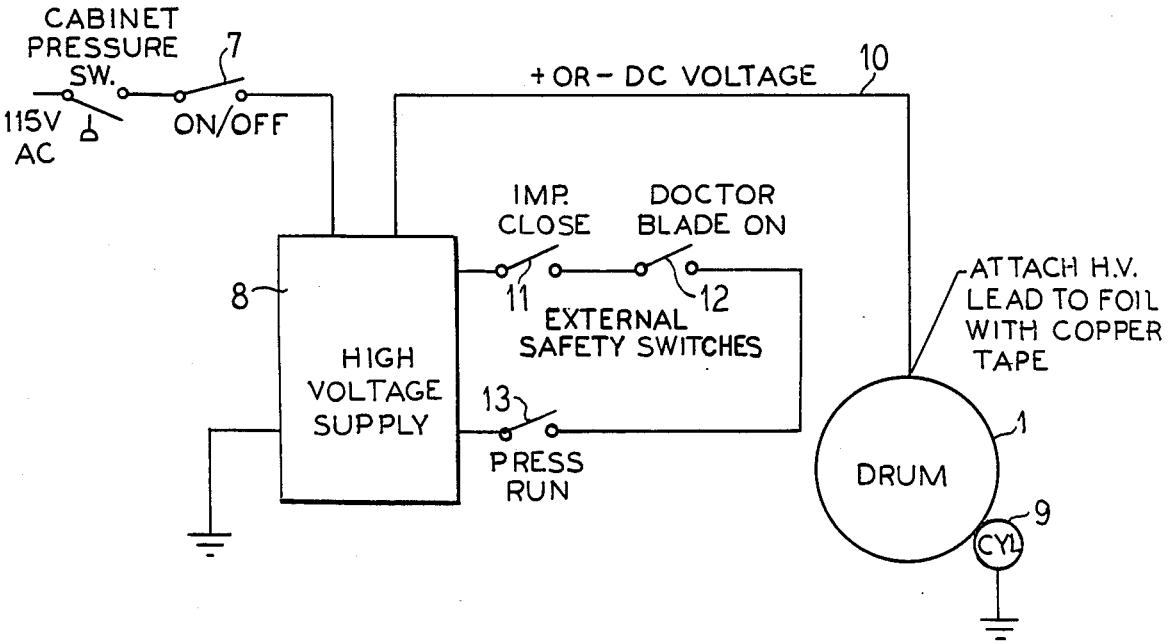
FIG. 2 is a schematic block diagram showing the components of the apparatus for practicing the method in accordance with the principles of the present invention.

As shown in FIG. 2, the drum 1, with the layers shown in detail in FIG. 1, is placed in a means for rotating the drum (not shown in detail). The apparatus is capable of rotating the drum 1 for approximately one rotation, but need not be capable of rotating the drum 1 for a full circumferential rotation.

The device is connected to a standard 1150 volt AC supply. A cabinet pressure switch 6 is used to purge the cabinet in which the printing operation is to take place in accordance with safety code standards. The air is evacuated in the cabinet in order to remove any fumes which may be present due to the volitile inks which are used. A main on/off switch 7 is closed thereby energizing a high voltage supply 8. The high voltage supply 8 may be, for example, a standard model 774 ESA, capable of producing approximately 3500 volts to approximately 4700 volts. The output of the high voltage supply 8 is connected via a lead 10 to the foil side of the paper/foil layer 4, in a manner described in further detail below. The voltage applied to the paper/foil layer 4 may be either positive or negative, depending upon the type of ink to be used. The selection of positive or negative voltage can be made by a manual sw on the high voltage supply 8.

A rotogravure cylinder 9 to be proofed is brought into pressurized contact with the surface of the drum 1, i.e., the proofing sheet 5 wrapping the drum 1. A circuit simulating the standard safety switches which may be present in the actual printing machine in which the rotogravure cylinder 9 is to be used is provided, consisting of an impression close switch 11, a doctor blade on switch 12, and a press run switch 13. When the necessary conditions for closing each of these switches have been met (the switches may be closed either automatically in response to sensed conditions, or manually) the high voltage supply 8 is permitted to supply high voltage through the proofing sheet 5 in a circuit to ground completed by the rotogravure cylinder 9. This voltage is applied only when it is assured that no personnel are in contact with any portion of the device. The drum 1 is then rotated through a partial revolution which is sufficient to receive the entire impression of the smaller-diameter rotogravure cylinder 9, the cups of which have been inked. The full impression of the rotogravure cylinder 9 is then transferred to the proofing sheet 5, which can be inspected so that any adjustment switch should be made to the cups of the rotogravure cylinder 9 can be undertaken.

Figure 3:
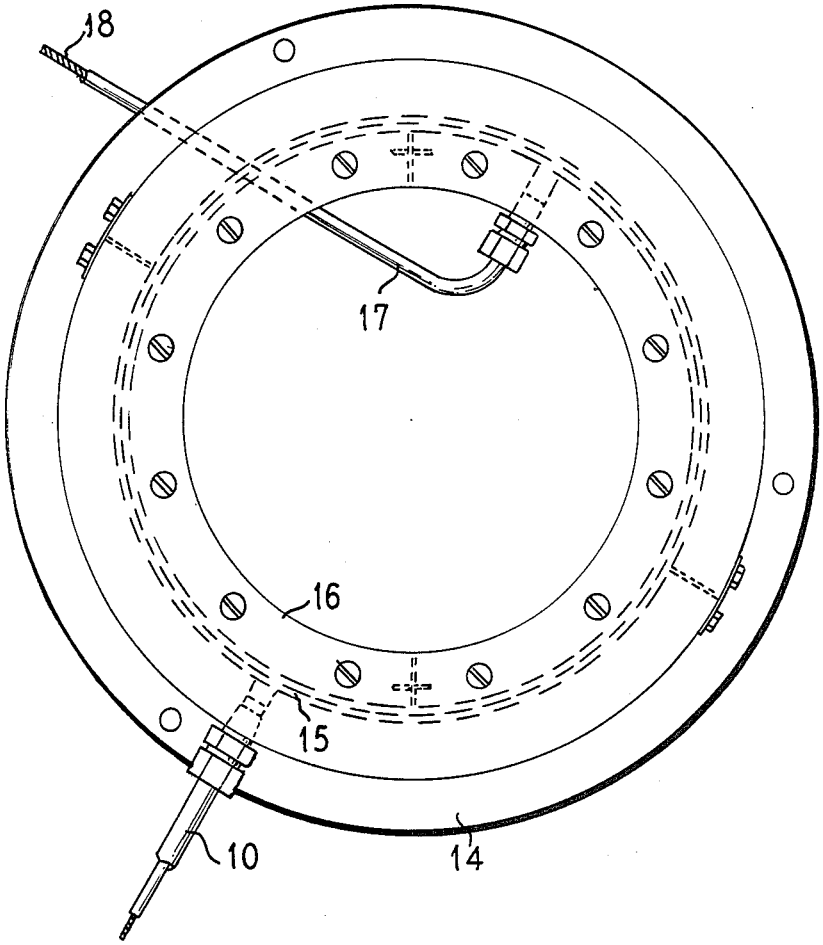
FIG. 3 is a side elevational view of selected portions of the drum showing the manner of electrical connection to the foil of the paper/foil layer.

As shown in FIG. 3, electrical connection to the foil side of the paper/foil layer 4 is made by a slip ring arrangement. The arrangement consists of concentric rings, one of which is stationary and the other of which is rotatable relative thereto. In the embodiment shown in FIG. 3, an outer ring 14, to which the lead 10 from the high voltage supply 8 is connected, is stationary. The outer ring 14 makes electrical connection with an inner rotatable ring 15 by means of suitable brushes 16 (not shown in greater detail). The brushes may, for example, be in the form of spring fingers to maintain electrical connection between the rings. The rotatable ring 16 has a lead 17 connected thereto which has an exposed free end 18 at which the electrical conductor is bared. The free end 18 is taped by means of copper tape having a conductive adhesive to a suitable location, where available, on the foil side of the paper/foil layer 4. The blanket layer 3 may, for example, be held on the drum 1 by means of a clamping arrangement, which will create a slight depression in which the conductor 17 can be laid. This slight depression can also be used to indicate the beginning and end of the partial rotation of the drum 1 by arranging the indentation just past the rotogravure cylinder 9 before beginning a proofing operation and rotating the drum 1 until the oepression reaches a location just before the rotogravure cylinder 9. This ensures that the depression or slot does not pass in the nip formed by the drum 1 and the cylinder 9.

Although modifications and changes may be suggested by those skilled in the art it is the intention of the inventors to embody within the patent warranted hereon all changes and modifications as reasonably and properly come within the scope of their contribution to the art.

We claim as our invention:

1. A method for proofing a rotogravure cylinder comprising the steps of:

preparing a drum having an outer surface with a plurality of layers in sequence including a plastic insulating layer, a rubber composite layer, a paper/foil layer having a paper slide and a foil side with said paper side disposed adjacent said rubber composite layer, and a proofing sheet layer completely wrapping the exterior of said drum;

attaching a lead to said foil side of said paper/foil layer;

bringing a grounded, inked rotogravure cylinder to be proofed in contact with said drum wrapped by said layers; and applying a high voltage through said proofing sheet and said foil side of said paper/foil layer to ground while rotating said drum through less than one rotation for assisting in the transfer of ink from said rotogravure cylinder onto said proofing sheet to obtain a rotogravure impression on said proofing sheet.

* * * * *